United States Patent [19]

Murata et al.

[11] 3,998,762

[45] Dec. 21, 1976

[54] GRANULAR OR POWDERY DETERGENT COMPOSITION

[75] Inventors: Moriyasu Murata, Chiba; Makoto Yamanaka, Koganei; Fumio Sai, Funabashi; Takashi Fujino, Yokohama, all of Japan

[73] Assignee: Kao Soap Co., Ltd., Tokyo, Japan

[22] Filed: Nov. 17, 1975

[21] Appl. No.: 632,194

[30] Foreign Application Priority Data

Nov. 20, 1974 Japan ..... 49-133463

[52] U.S. Cl. ..... 252/551; 252/531; 252/532; 252/384; 252/533; 252/534; 252/535; 252/536; 252/537; 252/539; 252/540; 252/550; 252/552; 252/553; 252/554; 252/555; 252/556; 252/558; 252/559

[51] Int. Cl.[2] ..... C11D 1/37; C11D 3/065

[58] Field of Search ..... 252/550, 551, 554, 555, 252/557, 558, 532, 535, 536, 539, 89, 384

[56] References Cited

UNITED STATES PATENTS

| | | | |
|---|---|---|---|
| 3,009,882 | 11/1961 | Clarke et al. | 252/116 |
| 3,325,422 | 6/1967 | Marquis | 252/383 |
| 3,328,314 | 6/1967 | Marquis | 252/383 |
| 3,424,690 | 1/1969 | Marquis | 252/384 X |
| 3,850,678 | 11/1974 | Watson | 252/384 X |
| 3,960,780 | 6/1976 | Murata et al. | 252/532 |

*Primary Examiner*—P.E. Willis, Jr.
*Attorney, Agent, or Firm*—Woodhams, Blanchard and Flynn

[57] ABSTRACT

A granular or powdery detergent composition containing as a detergent active component a surfactant having a tendency to cake, wherein the composition contains as a caking-preventing agent the combination of (a) at least 0.2% by weight of a polyethylene glycol having a molecular weight of at least 2000 and (b) at least 0.2% by weight of at least one anhydrous organic acid, or anhydride, or salt thereof, selected from the group consisting of sulfosuccinic acid and its salts, maleic anhydride, maleic acid and its salts, succinic anhydride, succinic acid and its salts, the total amount of the components (a) and (b) being 0.4 to 40% by weight, based on the weight of the detergent composition.

3 Claims, No Drawings

GRANULAR OR POWDERY DETERGENT COMPOSITION

BACKGROUND OF THE INVENTION

1. Field of the Invention

This invention relates to a method for preventing caking of surfactants that have a tendency to cake, to granular or powdery detergent compositions containing as an active ingredient such a surfactant, and to non-caking powdery or granular detergent compositions. More specifically, this invention relates to the use of a special anti-caking agent composition for reducing the caking tendency of granular or powdery detergent compositions containing one or more surfactants that have a significant tendency to cake, such as alkylethoxy sulfates, alkylphenylethoxy sulfates, branched alkyl sulfates, alkane sulfonates, vinylidene-type olefin sulfonates, internal olefin sulfonates and ethylene oxide-type non-ionic surface active agents.

2. Description of the Prior Art

Caking of powdery or granular detergent compositions has a bad influence not only on the detergent-manufacturing steps, but also on the handling of the detergent composition when it is put into practical use for clothes-washing in housholds. This caking phenomenon seriously reduces the commercial value of powdery or granular detergent compositions. Therefore, it is very important to overcome this tendency of caking of powdery or granular detergent compositions.

The tendency toward caking of a granular or powdery detergent is greatly influenced by the kind of the surfactants employed therein. Some satisfactory compositions are known. For example, sodium benzene sulfonate and sodium toluene sulfonate have a good effect for preventing caking in branched alkyl benzene sulfonates, and sodium sulfosuccinate is similarly effective for linear alkyl benzene sulfonates. However, it is said that sodium sulfosuccinate is not effective for the former type surfactants, and sodium benzene sulfonate and sodium toluene sulfonate are not effective for the latter type surfactants.

Although the surfactants that have a significant tendency to cake, exemplified in the first paragraph of this specification above, have an excellent washing activity, granular or powdery detergent compositions containing such surfactants are likely to cake and their commercial values are thereby seriously reduced.

SUMMARY OF THE INVENTION

We have discovered that when the combination of (a) a polyethylene glycol having a molecular weight of at least 2000 and (b) at least one anhydrous organic acid, or its anhydride, or its salt, selected from the group consisting of sulfosuccinic acid and its salts, maleic anhydride, maleic acid and its salts, succinic anhydride, and succinic acid and its salts, is employed as a caking-preventive agent composition in admixture with surfactants having a significant tendency to cake, a synergistic caking-preventive effect is obtained. It was also found that the caking property of the above-mentioned surfactants that have a significant tendency to cake, or powdery or granular detergent compositions containing one or more of such surfactants, can be improved to satisfactory levels only when the polyethylene glycol (a) is used in combination with at least one anhydrous organic acid, its anhydride, or its salt (b). The caking-preventive effect of the polyethylene glycol (a) when used alone is insufficient, but it can be highly enhanced by its conjoint use with the organic acid, its anhydride, or its salts (b). This is surprising because when the anhydrous organic acid, its anhydride, or its salt (b) is employed by itself in a detergent composition containing the above named surfactants that have a significant tendency toward caking, no substantial caking-preventive effect can be obtained.

Polyethylene glycols have heretofore been used in compositions containing surfactants, as re-contamination preventing or anti-redeposition agents, or as dispersing agents (British Patent No. 1,293,359), hand chapping preventing agents (Japanese Patent Application Laid-Open Specification No. 10103/73) and as thickeners (Japanese Patent Publication No. 1703/69), but they have not been used as caking-preventive agent ingredients for granular or powdery detergents.

It is known to use the anhydrous organic acid, or its organic acid salt (b) as a caking-preventive agent for alkylbenzene sulfonates, but it is not significantly effective by itself as a caking-preventive agent for alkylethoxy sulfates, alkylphenylethoxy sulfates, branched alkyl sulfates, alkane sulfonates, vinylidene-type olefin sulfonates, internal olefin sulfonates and ethylene oxide-type non-ionic surface active agents.

In accordance with this invention, there is provided a granular or powdery detergent composition containing as a detergent active component a surfactant having a tendency to cake, characterized in that the composition comprises as a caking-preventive agent the combination of (a) at least 0.2% by weight of a polyethylene glycol having a molecular weight of at least 2000 and (b) at least 0.2% by weight of at least one anhydrous organic acid, its anhydride, or its salts, selected from the group consisting of sulfosuccinic acid and its salts, maleic anhydride, maleic acid and its salts, succinic anhydride, succinic acid and its salts, wherein the total amount of the components (a) and (b) is from 0.4 to 40% by weight, based on the weight of the detergent composition. Thus, both (a) and (b) can be employed in amounts in the range of from 0.2 to 39.8% by weight, based on the weight of the detergent composition, provided that the sum of (a) plus (b) is not more than 40% by weight. It is preferred to use each of (a) and (b) in amounts in the range of from 1 to 8 percent by weight, based on the weight of the detergent composition. It is further preferred that the sum of (a) and (b) is from 4 to 12 percent by weight based on the weight of the detergent composition.

The organic acids, organic acid anhydrides and organic acid salts that are used as the component (b) of the caking-preventive agent of this invention are defined as follows:

1. Succinic acid and its salts having the following formula:

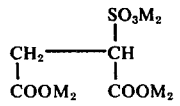

wherein $M_2$ is hydrogen, an alkali metal or an alkaline earth metal.

2. Maleic anhydride having the following formula:

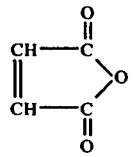

3. Maleic acid and its salts having the following formula:

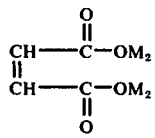

wherein $M_2$ is hydrogen, an alkali metal or an alkaline earth metal.

4. Succinic anhydride having the following formula:

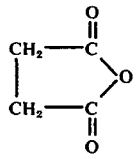

5. Succinic acid and its salts having the following formula:

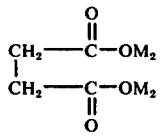

wherein $M_2$ is hydrogen, an alkali metal or an alkaline earth metal.

Examples of surface active agents having a significant tendency to cake, to which the caking-preventive agent composition of this invention can be effectively applied, are as follows:

a. Alkylethoxy sulfates having the following formula

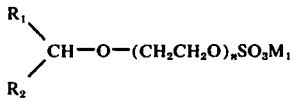

and b. alkylphenylethoxy sulfates having the following formula

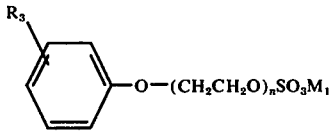

wherein $R_1$ and $R_2$ are hydrogen or an alkyl or alkenyl having 1 to 21 carbon atoms, $R_3$ is alkyl or alkenyl having 4 to 16 carbon atoms, the average carbon atom number of the alcohol or alkylphenol before addition of ethylene oxide being 10 to 22, n is a positive number of 1 to 50, and $M_1$ is an alkali metal or an alkaline earth metal.

c. Branched alkyl sulfates having the following formula

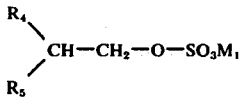

wherein $R_4$ and $R_5$ are alkyl or alkenyl having 1 to 20 carbon atoms, provided that the number of the total carbon atoms in the molecule is 10 to 22, and $M_1$ is an alkali metal or an alkaline earth metal.

d. Alkane sulfonates having the following formula

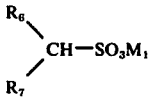

wherein $R_6$ and $R_7$ are hydrogen or an alkyl having 1 to 21 carbon atoms, provided that the number of the total carbon atoms in the molecule is 10 to 22, and $M_1$ is an alkali metal or an alkaline earth metal.

e. Vinylidene-type olefin sulfonates, namely sulfonic acid salts of olefins having the following formula

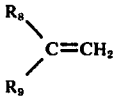

wherein $R_8$ and $R_9$ are alkyl having 1 to 21 carbon atoms, provided that the number of the total carbon atoms in the molecule is 10 to 22.

As the salt-forming cation, there can be mentioned alkali metal or alkaline earth metal cations.

f. Internal olefin sulfonates, namely sulfonic acid salts of olefins having the following formula

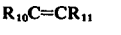

wherein $R_{10}$ and $R_{11}$ are alkyl having 1 to 19 carbon atoms, provided that the number of the total carbon atoms in the molecule is 10 to 22.

If one of $R_{10}$ and $R_{11}$ is hydrogen, the compound of the above formula is an $\alpha$-olefin. An $\alpha$-olefin may be contained in an amount of from zero to 80% of total olefins.

As the salt-forming moiety, there can be mentioned alkali metal cations or alkaline earth metal cation.

g. Ethylene oxide type non-ionic surface active agents such as polyoxyethylene (1–30) alkyl ($C_{12}$ to $C_{18}$) or alkenyl ($C_{12}$ to $C_{18}$) ethers, polyoxyethylene (1.5 to 30) alkyl ($C_8$ to $C_{16}$) phenyl ethers, polyoxyethylene (8–30) saturated or unsaturated fatty acid ($C_{10}$ to $C_{22}$) esters, and polyoxyethylene (4–30) sorbitan saturated or unsaturated fatty acid ($C_{10}$ to $C_{22}$) esters.

It is preferred to use sodium or potassium salts of surfactants (a) to (f), and sodium salts are especially preferred.

The detergent composition of this invention contains about 1 to about 50% by weight of one member or a mixture of two or more members selected from the above-mentioned group of surfactants that have a significant tendency to cake, as the principal active ingredient. In addition, the detergent composition of this invention can contain as a second surfactant component, alkali metal salts, such as sodium and potassium salts, of alkylbenzene sulfonates containing an alkyl group having 10 to 16 carbon atoms, linear alkyl sulfuric acid esters having 11 to 18 carbon atoms on the average or α-olefin sulfonic acids having 10 to 20 carbon atoms and mixtures thereof. The amount of the second surfactant component can be from zero to 35% by weight, and the sum of the cakeable surfactant and the second surfactant preferably does not exceed 50 percent by weight. It is preferred to use from 10 to 30% by weight of the second surfactant or mixtures thereof, and from 5 to 15% by weight of a surfactant having a tendency to cake or mixtures thereof. In addition, there can be used other conventional components of clothes-washing detergent compositions, used in the conventional amounts, such as inorganic alkaline builders such as condensed phosphoric acid salts, e.g., sodium tripolyphosphate and sodium pyrophosphate, silicates, carbonates, and borates; inorganic neutral builders such as sodium sulfate; organic builders such as nitrilotriacetates and citrates; re-contamination preventing or anti-redeposition agents such as carboxymethyl cellulose, polyvinyl alcohol, polyvinylpyrrolidone; enzymes; bleaching agents; fluorescent dyes; bluing agents; perfumes and additives customarily used for clothes-washing detergents.

In this invention, provided that each of the components (a) and (b) of the caking-preventive agent composition is used in an amount of at least 0.2% by weight, a synergistic effect can be obtained. The upper limit of the amounts of the components of the caking-preventive agent composition are not particularly critical, but from the economical viewpoint, it is not advantageous to use the caking-preventive agent composition in an amount exceeding 40% by weight (sum of (a) plus (b)).

This invention will now be further described by reference to the following illustrative Examples.

Each of the detergent compositions described in these Examples was prepared and tested in the following manner:

A detergent slurry consisting of 60% by weight of the detergent components and 40% by weight of water was charged in a mixing mortar and the slurry was mixed and agitated uniformly at 60° C. The slurry was then dried at 60° to 80° C under reduced pressure in a vacuum drum drier until the water content was reduced to substantially zero. The resulting powdery detergent was sieved and particles having a size of 420 to 710 μ were recovered. These particles were allowed to stand still in a tank maintained at a temperature of 30° ± 1° C and a relative humidity of 80 ± 3% to adjust the water content to be 9 ± 1% by weight. Then the detergent was tested.

The caking property was determined in the following manner:

12.5 g of each detergent sample was filled in a container formed of filter paper (7.4 cm × 4.4 cm × 2.8 cm (height)), and the sample was levelled. An iron plate having a size of 7.2 cm × 4.2 cm was placed on the sample, and in this state the sample was allowed to stand still in a thermostat tank maintained at a temperature of 30° ± 2° C and a relative humidity of 80% for 7 days. Then, the powdery detergent was placed on a sieve of 4 mm × 4 mm mesh to allow the particles to pass therethrough. The weight A (g) of the powder that remained on the sieve and the weight B (g) of the powder that passed through the sieve were measured. The passage ratio was calculated according to the following equation:

$$\text{Passage ratio (\%)} = \frac{B}{A+B} \times 100$$

A larger value of the passage ratio indicates a lower degree of caking.

EXAMPLE 1

According to the methods set forth above, powder detergents having the following compositions were prepared and their passage ratios were determined.

In the following recipe, the values for (a) through (g) are set forth in the following table.

| Detergent Composition | % by weight |
|---|---|
| surfactant | a |
| sodium tripolyphosphate | 20 |
| sodium silicate (JIS No. 2) | 10 |
| sodium carbonate | 5 |
| polyethylene glycol (PEG) (molecular weight = 6000) | b |
| sodium sulfosuccinate (SS) | c |
| sodium maleate (MA) | d |
| maleic anhydride (MAn) | e |
| sodium succinate (S) | f |
| succinic anhydride (SAn) | g |
| carboxymethyl cellulose | 0.5 |
| water | 8 |
| Glauber's salt | balance |
| total | 100 |

Table 1

| Run No. | Surfactant Kind | (a %) | PEG (b %) | SS (c %) | MA (d %) | MAn (e %) | S (f %) | SAn (g %) | Passage Ratio (%) |
|---|---|---|---|---|---|---|---|---|---|
| 1 | sodium alkylethoxy sulfate[1] | 15 | 0 | 0 | 0 | 0 | 0 | 0 | 0 |
| 2 | " | 15 | 4 | 2 | 0 | 0 | 0 | 0 | 87 |
| 3 | " | 15 | 5 | 0 | 4 | 0 | 0 | 0 | 89 |
| 4 | " | 15 | 4 | 0 | 0 | 3 | 0 | 0 | 88 |
| 5 | " | 15 | 5 | 0 | 0 | 0 | 5 | 0 | 90 |
| 6 | " | 15 | 5 | 0 | 0 | 0 | 0 | 7 | 91 |
| 7 | sodium alkylethoxy sulfate[2] | 20 | 0 | 0 | 0 | 0 | 0 | 0 | 0 |
| 8 | " | 20 | 6 | 0 | 0 | 0 | 0 | 4 | 89 |
| 9 | sodium alkylethoxy sulfate[3] | 15 | 0 | 0 | 0 | 0 | 0 | 0 | 0 |
| 10 | " | 15 | 5 | 6 | 0 | 0 | 0 | 0 | 87 |
| 11 | sodium branched alkyl sulfate[4] | 25 | 0 | 0 | 0 | 0 | 0 | 0 | 54 |
| 12 | " | 25 | 3 | 0 | 0 | 0 | 0 | 0 | 74 |

Table 1-continued

| Run No. | Surfactant Kind | (a %) | PEG (b %) | SS (c %) | MA (d %) | MAn (e %) | S (f %) | SAn (g %) | Passage Ratio (%) |
|---|---|---|---|---|---|---|---|---|---|
| 13 | " | 25 | 0 | 5 | 0 | 0 | 0 | 0 | 57 |
| 14 | " | 25 | 0 | 0 | 5 | 0 | 0 | 0 | 54 |
| 15 | " | 25 | 0 | 0 | 0 | 5 | 0 | 0 | 56 |
| 16 | " | 25 | 0 | 0 | 0 | 0 | 5 | 0 | 54 |
| 17 | " | 25 | 0 | 0 | 0 | 0 | 0 | 5 | 55 |
| 18 | " | 25 | 2 | 2 | 0 | 0 | 0 | 0 | 96 |
| 19 | " | 25 | 2 | 0 | 4 | 0 | 0 | 0 | 97 |
| 20 | " | 25 | 2 | 0 | 0 | 3 | 0 | 0 | 98 |
| 21 | " | 25 | 2 | 0 | 0 | 0 | 5 | 0 | 98 |
| 22 | " | 25 | 2 | 0 | 0 | 0 | 0 | 4 | 97 |
| 23 | sodium alkane sulfonate[5] | 18 | 0 | 0 | 0 | 0 | 0 | 0 | 10 |
| 24 | " | 18 | 3 | 0 | 3 | 0 | 0 | 0 | 91 |
| 25 | sodium vinylene-type olefin sulfonate[6] | 16 | 0 | 0 | 0 | 0 | 0 | 0 | 48 |
| 26 | " | 16 | 1 | 0 | 0 | 0 | 0 | 5 | 83 |
| 27 | sodium internal olefin sulfonate[7] | 17 | 0 | 0 | 0 | 0 | 0 | 0 | 28 |
| 28 | " | 17 | 2 | 1 | 0 | 0 | 0 | 0 | 81 |
| 29 | polyoxyethylene nonylphenyl ether[8] | 8 | 0 | 0 | 0 | 0 | 0 | 0 | 31 |
| 30 | " | 8 | 3 | 0 | 0 | 5 | 0 | 0 | 85 |
| 31 | sodium linear dodecylbenzene sulfonate | 20 | 0 | 0 | 0 | 0 | 0 | 0 | 96 |
| 32 | " | 20 | 3 | 0 | 0 | 0 | 1 | 0 | 98 |
| 33 | sodium linear alkyl sulfate[9] | 20 | 0 | 0 | 0 | 0 | 0 | 0 | 98 |
| 34 | " | 20 | 3 | 0 | 0 | 0 | 0 | 1 | 100 |
| 35 | sodium α-olefin sulfonate[10] | 20 | 0 | 0 | 0 | 0 | 0 | 0 | 99 |
| 36 | " | 20 | 3 | 0 | 0 | 1 | 0 | 0 | 100 |

The surface active agents set forth in Table 1 are those obtained in the following manner:

1. Sodium obtained by adding 3.4 moles of ethylene oxide to a linear higher alchol (having 14 carbon atoms on the average), followed by sulfation and neutralization.

2. Sodium salt obtained by adding 2.8 moles of ethylene oxide to Oxocohol 1415 which is a mixture of a branched higher alcohol and a linear higher alcohol (manufactured by Nissan Kagaku; average carbon atom number = 14.5; alkyl group branching ratio = 60 %), followed by sulfation and neutralization.

3. Unitol C-S (manufactured by Nippon Unitol; sodium salt of a sulfuric acid ester of an ethoxide of a secondary higher alcohol having 14 to 15 carbon atom).

4. Sodium salt of a sulfated product of an oxoalcohol having an average molecular weight of 205.

5. Hostabuar 60 (manufactured by Hoechst AG, West Germany; average molecular weight = 319 )

6. average carbon number = 16

7. sodium salf of a sulfonic acid ester of olefins composed mainly of internal olefins (α-olefin/internal olefin = 20/80; average carbon number = 16.2 ).

8. added ethylene oxide mole number = 8.4

9. Sodium salt of a sulfuric acid ester of a linear higher alcohol (average carbon number = 14 ).

10. Sodium α-olefin sulfonate derived from Dialene (manufactured by Mitsubishi Kasei; linear α-olefin mixtures; carbon number = 16 (57.3%), 18 (42.7%)).

The samples of Runs. Nos. 1, 7, 9, 11 to 17, 23, 25, 27, 29, 31, 33 and 35 are comparative samples. Further, Runs Nos. 31–36 were made using surfactants that do not have a significant tendency to cake.

As is apparent from the results shown in Table 1, in powdery detergents containing a surface active agent having a tendency to cake, serious caking readily occurs, when no caking-preventive agent composition is used, but when there is used a caking-preventive agent composition consisting of PEG and at least one member selected from sodium sulfosuccinate, sodium maleate, maleic anhydride, sodium succinate and succinic anhydride, caking can be effectively prevented due to their synergistic effect.

EXAMPLE 2

Detergents having the composition indicated below were prepared, and the influence of the amounts of PEG and SS, MA, MAn, S or SAn blended therein were examined.

| Detergent Composition | % by weight |
|---|---|
| sodium dodecylbenzene sulfonate | 16 |
| sodium alkylethoxy sulfate (the same as used in Example 1) | 4 |
| sodium tripolyphosphate | 25 |
| sodium silicate (JIS No. 2) | 12 |
| sodium carbonate | 5 |
| CMC | 1 |
| polyethylene glycol (PEG) (average molecular weight = 6000) | as indicated in Tables 2 to 6 |
| sodium sulfosuccinate (SS) | |
| sodium maleate (MA) | |
| maleic anhydride (MAn) | |
| sodium succinate (S) | |
| succinic anhydride(SAn) | |
| water | 9 |
| Glauber's salt | balance |
| & total | 100 |

(1) PEG/SS

Table 2

| | PEG | SS | Passage Ratio (%) |
|---|---|---|---|
| Comparison | & 0 | & 0 | 25 |
| | 0.3 | 0 | 48 |
| | 0.1 | 0.1 | 42 |
| | 0.5 | 0.1 | 49 |
| This Invention | 0.2 | 0.3 | 67 |
| | 0.3 | 0.2 | 68 |
| | 3 | 3 | 96 |
| Comparison | 3 | 0 | 83 |
| | 0 | 3 | 41 |

-continued (2) PEG/MA

Table 3

| | PEG | SS | Passage Ratio (%) |
|---|---|---|---|
| Comparison | 0 | 0 | 25 |
| | 0.3 | 0.1 | 45 |
| This Invention | 0.3 | 0.3 | 62 |

(3) PEG/MAn

Table 4

| | PEG | SS | Passage Ratio (%) |
|---|---|---|---|
| Comparison | 0 | 0 | 25 |
| | 0.1 | 0.5 | 41 |
| This Invention | 0.2 | 0.3 | 66 |

(4) PEG/S

Table 5

| | PEG | SS | Passage Ratio (%) |
|---|---|---|---|
| Comparison | 0 | 0 | 25 |
| | 0.4 | 0.1 | 51 |
| This Invention | 0.3 | 0.3 | 64 |

(5) PEG/SAn

Table 6

| | PEG | SAn | Passage Ratio (%) |
|---|---|---|---|
| Comparison | & 0 | & 0 | 25 |
| | 0.2 | 0.1 | 42 |
| | 0 | 1 | 40 |
| This Invention | 0.3 | 0.2 | 65 |

As is apparent from the results shown in Tables 2 to 6, by the combined use of PEG with SS, MA, MAn, S or SAn, the caking-preventive effect is synergistically enhanced. An effect comparable to the effect attained by the incorporation of a large quantity of PEG can be attained by incorporation of only a small amount of the caking-preventive agent composition of this invention. It is also seen that this excellent effect is attained only when each of PEG and SS, MA, MAn, S or SAn is incorporated in an amount of at least 0.2 % and the sum of the amounts of the two ingredients is at least 0.4 %.

EXAMPLE 3

There were prepared various detergent compositions that differed in the combination of the surfactants employed and the passage ratios of these detergent compositions were measured.

The compositions and the results are shown in Table 7.

Table 7

| Composition (%) | Run No. 37 | Run No. 38 | Run No. 39 | Run No. 40 | Run No. 41 | Run No. 42 | Run No. 43 | Run No. 44 | Run No. 45 | Run No. 46 |
|---|---|---|---|---|---|---|---|---|---|---|
| sodium dodecylbenzene sulfonate | 10 | 10 | 10 | 10 | 10 | 10 | 8 | 8 | 15 | 15 |
| sodium alkyl sulfate[1] | 10 | 10 | — | — | — | — | — | — | 5 | 5 |
| sodium α-olefin sulfonate[2] | — | — | — | — | 3 | 3 | — | — | — | — |
| sodium alkylethoxy sulfate[3] | 10 | 10 | — | — | — | — | — | — | — | — |
| sodium branched alkyl sulfate[4] | — | — | 10 | 10 | — | — | — | — | — | — |
| sodium alkane sulfonate[5] | — | — | — | — | — | — | 12 | 12 | — | — |
| sodium vinylidene-type olefin sulfonate[6] | — | — | — | — | 7 | 7 | — | — | — | — |
| polyoxyethylene dodecyl ether[7] | — | — | — | — | — | — | — | — | 4 | 4 |
| sodium tripolyphosphate | 28 | 28 | 20 | 20 | 22 | 22 | 18 | 18 | 20 | 20 |
| sodium silicate | 10 | 10 | 13 | 13 | 11 | 11 | 8 | 8 | 8 | 8 |
| sodium carbonate | 5 | 5 | 5 | 5 | 3 | 3 | 5 | 5 | 4 | 4 |
| CMC | 1 | 1 | 1 | 1 | 1 | 1 | 1 | 1 | 0.5 | 0.5 |
| PEG (MW = 6000) | — | 3 | — | 1 | — | 2 | — | 1 | — | 3 |
| SS | — | 3 | — | — | — | — | — | — | — | — |
| MA | — | — | — | 3 | — | — | — | — | — | — |
| MAn | — | — | — | — | — | — | — | — | — | 2 |
| S | — | — | — | — | — | 2 | — | — | — | — |
| SAn | — | — | — | — | — | — | — | 2 | — | — |
| water | 10 | 10 | 10 | 10 | 5 | 5 | 8 | 8 | 9 | 9 |
| Glauber's salt | balance | balance | balance | balance | balance | balance | balance | balance | balance | balance |
| Passage Ratio (%) | 0 | 85 | 21 | 100 | 0 | 81 | 13 | 82 | 19 | 84 |

Notes:
[1] same as 9) in Table 1
[2] same as 10) in Table 1
[3] same as 1) in Table 1
[4] same as 4) in Table 1
[5] same as 5) in Table 1
[6] same as 6) in Table 1
[7] added ethylene oxide mole number = 8.4

The samples of Runs Nos. 37, 39, 41, 43 and 45 are comparative samples.

EXAMPLE 4

Among the compositions shown in Example 1 , one comprising 15 % by weight of the sodium alkylethoxy sulfate (sodium salt obtained by adding 3.4 moles of ethylene oxide to a linear higher alcohol having 14 carbon atoms on the average), followed by sulfation and neutralization, 4 % by weight of the polyethylene glycol (the molecular weight was changed as indicated in Table 8 ) and 4 % by weight of sodium sulfosuccinate was tested to examine the influences of the molecular weight of the polyethylene glycol. The results are shown in Table 8.

Table 8

| Average Molecular Weight of Polyethylene Glycol | Passage Ratio (%) |
|---|---|
| 400 | 12 |
| 1,000 | 20 |
| 2,000 | 51 |
| 4,000 | 79 |
| 6,000 | 87 |
| 10,000 | 88 |
| 50,000 | 75 |
| 80,000 | 80 |
| 500,000 | 82 |

Table 8-continued

| Average Molecular Weight of Polyethylene Glycol | Passage Ratio (%) |
|---|---|
| 1,000,000 | 81 |

As is seen from the results shown in the above Table 8, when a polyethylene glycol is employed having an average molecular weight not lower than the lower limit at which the polyethylene glycol is solid at a temperature approximating room temperature, namely an average molecular weight not lower then about 2000, is used in combination with sodium sulfosuccinate, an excellent synergistic effect of preventing caking is attained.

EXAMPLE 3

Among the compositions shown in Example 2, one comprising 2 % by weight of the polyethlene glycol (having an average molecular weight of 6000 ) and 3 % by weight of the organic acid or its salt was tested to examine how the caking-preventive effect is influenced by the form and state of the organic acid or its salt prior to addition to the detergent slurry. Results are shown in Table 9.

Table 9

| Acid or Salt as Component (b) of Caking-Preventive Agent of This Invention | | Passage Ratio (%) |
|---|---|---|
| (1) | Sulfosuccinic acid (A) | 95 |
| | Neutralization product of 1 mole of (A) and 1 mole of NaOH | 95 |
| | Neutralization product of 1 mole of (A) and 2 moles of KOH | 94 |
| | Neutralization product of 1 mole of (A) and 3 moles of NaOH | 96 |
| | Neutralization product (B) of 1 mole of (A) and 1 mole of $Ca(OH)_2$ | 93 |
| | 1 : 1 weight ratio mixture of (A) and (B) | 93 |
| | Neutralization product of 1 mole of (A) and 1.5 moles of $Mg(OH)_2$ | 94 |
| (2) | Maleic acid (C) | 92 |
| | Neutralization product of 1 mole of (C) and 1 mole of NaOH | 93 |
| (3) | Succinic acid (D) | 93 |
| | Neutralization product of 1 mole of (D) and 1 mole of KOH | 93 |

From data shown in Table 9, it will readily be understood that the component (b) exhibits an excellent effect whether it is used in the form of an acid or a metal salt.

The embodiments of the invention in which an exclusive property or privilege is claimed are defined as follows:

1. A granular or powdery detergent composition consisting essentially of

I. from 1 to 50 percent by weight of a first surfactant having a tendency to cake selected from the group consisting of (a) alkylethoxy sulfates having the formula

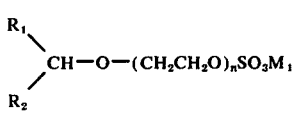

wherein $R_1$ and $R_2$, which can be the same or different, are hydrogens, alkyls having one to 21 carbon atoms, or alkenyls having one to 21 carbon atoms, provided that

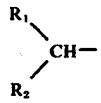

number of from 1 to 50, and $M_1$ is an alkali metal or an alkaline earth metal, b. alkylphenylethoxy sulfates having the formula

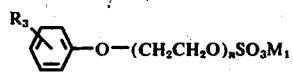

wherein $R_3$ is alkyl having 4 to 16 carbon atoms or alkenyl having 4 to 16 carbon atoms, and *n* and $M_1$ are the same as defined above, c. branched alkyl sulfates having the formula

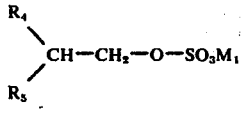

wherein $R_4$ and $R_5$, which can be the same or different, are alkyls having one to 20 carbon atoms or alkenyls having one to 20 carbon atoms, provided that

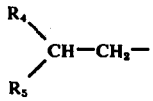

and $M_1$ is the same as defined above d. alkane sulfonates having the formula

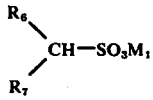

wherein $R_6$ and $R_7$, which can be the same or different, are hydrogens, or alkyls having one to 21 carbon atoms, provided that

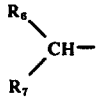

contains 10 to 22 carbon atoms, and $M_1$ is the same as defined above e. sulfonic acid salts of olefins having the formula

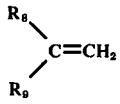

wherein $R_8$ and $R_9$, which can be the same or different, are alkyls having one to 21 carbon atoms, provided that the number of carbon atoms in the olefine molecule is from 10 to 22, and the salt-forming cation is an alkali metal or alkaline earth metal, f. sulfonic acid salts of olefins having the formula $R_{10}C{=}CR_{11}$, wherein $R_{10}$ and $R_{11}$, which can be the same or different, are hydrogens or alkyls having one to 19 carbon atoms, provided that the number of carbon atoms in the olefin molecule is from 10 to 22 and further provided that in up to 80 % of the olefin molecules, one of $R_{10}$ and $R_{11}$ can be hydrogen, and in the balance of the olefin molecules, neither of $R_{10}$ and $R_{11}$ is hydrogen, and the salt-forming cation is an alkali metal or alkaline earth metal, g. ethylene oxide non-ionic surface active agents selected from the group consisting of polyoxyethlene (1–30) alkyl ($C_{12}$ to $C_{18}$) or alkenyl ($C_{12}$ to $C_{18}$) ethers, polyoxethylene (1.5 to 30) alkyl ($C_8$ to $C_{16}$) phenyl ethers, polyoxyethylene (8–30) saturated or unsaturated fatty acid ($C_{10}$ to $C_{22}$) esters and polyoxyethylene (4–30) sorbitan saturated or unsaturated fatty acid ($C_{10}$ to $C_{22}$) esters, and mixtures thereof, II. an anti-caking agent composition consisting of a. from 0.2 to 39.8 percent by weight of polyethylene glycol having a molecular weight of at least 2000, and b. from 0.2 to 39.8 percent by weight of a substance selected from the group consisting of sulfosuccinic acid and its alkali and alkaline earth metal salts, maleic anhydride, maleic acid and its alkali and alkaline earth metal salts, succinic anhydride, succinic acid and its alkali and alkaline earth metal salts, and mixtures thereof, the sum of A and B being from 0.4 to 40 percent by weight, based on the weight of the detergent composition, and III. from zero to 35 percent by weight of second surfactant selected from the group consisting of alkylbenzene sulfonates in which the alkyl has 10 to 16 carbon atoms, linear alkyl sulfates having an average of 11 to 18 carbon atoms, α-olefin sulfonates having 10 to 20 carbon atoms and mixtures thereof, wherein the sum of the first and second surfactants does not exceed 50 percent by weight, based on the weight of the detergent composition, and IV. the balance of the composition is water-soluble inorganic alkaline detergent builders, or water-soluble inorganic neutral detergent builders, or water-soluble organic detergent builders, or mixtures thereof.

2. A detergent composition as claimed in claim 1 in which the amounts of polyethylene glycol A and substance B both are in the range of 1 to 8 percent by weight, and the sum of A and B is from 4 to 12 percent by weight, both percentages being based on the weight of the detergent composition.

3. A detergent composition as claimed in claim 2 containing from 10 to 30 percent by weight of said second surfactant and containing from 5 to 15 percent by weight of said first surfactant.

* * * * *

UNITED STATES PATENT AND TRADEMARK OFFICE

CERTIFICATE OF CORRECTION

PATENT NO. : 3 998 762

DATED : December 21, 1976

INVENTOR(S) : Moriyasu Murata, Makoto Yamanaka, Fumio Sai and Takashi Fujimo

It is certified that error appears in the above-identified patent and that said Letters Patent are hereby corrected as shown below:

Column 12, line 8; after the formula and before "number of" insert ---has from 10 to 22 carbon atoms, n is a---.

Column 12, line 38; after the formula and before "and $M_1$" insert ---contains from 10 to 22 carbon atoms,---.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*